US008347191B1

(12) United States Patent
Ran

(10) Patent No.: US 8,347,191 B1
(45) Date of Patent: Jan. 1, 2013

(54) METHOD AND SYSTEM FOR SOFT DECISION DECODING OF INFORMATION BLOCKS

(75) Inventor: Omer Ran, Re'ut (IL)

(73) Assignee: Mostlytek Ltd, Modi'In (IL)

( * ) Notice: Subject to any disclaimer, the term of this patent is extended or adjusted under 35 U.S.C. 154(b) by 1267 days.

(21) Appl. No.: 12/120,429

(22) Filed: May 14, 2008

Related U.S. Application Data

(60) Provisional application No. 60/917,684, filed on May 14, 2007.

(51) Int. Cl.
*H03M 13/00* (2006.01)

(52) U.S. Cl. ..... 714/784

(58) Field of Classification Search ..... 714/784
See application file for complete search history.

(56) References Cited

U.S. PATENT DOCUMENTS 5,802,078 A * 9/1998 Urabe et al. ..... 714/759
7,831,895 B2 * 11/2010 Lin ..... 714/800
7,849,388 B2 * 12/2010 Esumi et al. ..... 714/800
8,006,171 B2 * 8/2011 Wang ..... 714/782
8,028,216 B1 * 9/2011 Yeo et al. ..... 714/755
2006/0282756 A1 * 12/2006 Gammel et al. ..... 714/801

* cited by examiner

*Primary Examiner* — Amine Riad
(74) *Attorney, Agent, or Firm* — Oren Reches

(57) ABSTRACT

A receiver, including a memory unit and a processor, wherein the memory unit stores a sorted parity check matrix that is sorted according to reliabilities of columns; wherein reliabilities of columns are responsive to values of information elements of a soft demodulated received information block, wherein the processor is adapted to: (a) iterate over columns of the sorted parity check matrix to find independent columns and dependent columns; (b) find non-redundant dependent columns out of the dependent columns; wherein the finding is responsive to a relationship between a reliability of a dependent column and a reliabilities of multiple independent columns on which the dependent column depends; (c) select, out of a group of combinations of columns, a selected combination; wherein each combination of the group equals a syndrome; wherein the group of combinations includes independent columns and the non-redundant dependent columns; and (d) correct errors in response to the selected combination.

21 Claims, 6 Drawing Sheets

| I1 | I2 | I3 | I4 | I5 | I6 | I7 | I8 |
|---|---|---|---|---|---|---|---|
| 0.08 | 0.24 | 0.32 | 0.36 | 0.4 | 0.48 | 0.54 | 0.7 |
| 0 | 0 | 0 | 0 | 1 | 0 | 0 | 0 |
| 1 | 0 | 0 | 1 | 0 | 0 | 0 | 1 |
| 1 | 0 | 0 | 0 | 0 | 0 | 0 | 0 |
| 0 | 1 | 0 | 0 | 0 | 0 | 1 | 1 |
| 0 | 0 | 0 | 0 | 0 | 0 | 0 | 1 |
| 1 | 0 | 1 | 0 | 0 | 0 | 1 | 1 |
| 1 | 0 | 0 | 0 | 0 | 0 | 1 | 0 |
| 1 | 0 | 0 | 0 | 0 | 1 | 1 | 0 |

| D1 | D2 | D3 | D4 | D5 | D6 | D7 |
|---|---|---|---|---|---|---|
| 1.04 | 1.24 | 1.26 | 1.42 | 1.66 | 1.82 | 2.02 |
| 0 | 1 | 1 | 0 | 0 | 1 | 0 |
| 0 | 0 | 1 | 0 | 0 | 0 | 0 |
| 0 | 1 | 0 | 1 | 1 | 0 | 0 |
| 0 | 1 | 0 | 0 | 0 | 0 | 0 |
| 0 | 1 | 1 | 1 | 0 | 1 | 1 |
| 0 | 0 | 1 | 1 | 0 | 0 | 0 |
| 1 | 0 | 1 | 1 | 0 | 1 | 0 |
| 0 | 0 | 0 | 0 | 0 | 1 | 0 |

FIG. 5

METHOD AND SYSTEM FOR SOFT DECISION DECODING OF INFORMATION BLOCKS

FIELD OF THE INVENTION

The invention relates to methods and systems for soft decision decoding of information blocks.

BACKGROUND OF THE INVENTION

Recently, much progress has been achieved in designing error control coding (ECC) and soft decision decoding (SDD) to closely approach the Shannon limits. A classic lower bound on the "block error rate" (BLER) for finite block length and given code rate R is the sphere packing bound of Shannon, denoted SP59.

Some desired properties in ECC for modern communications systems are: (i) Optimal (in the sense of maximum likelihood decoding, or maximum posterior decoding) or near optimal that can approach the SP59 bound; (ii) Adaptive complexity to channel condition: It is highly desired to introduce optimal and near-optimal maximum likelihood (ML) decoders whose complexities are adaptable to the noise level of the channel. Ideally, it is desirable to reduce the number of computations at high signal to noise ration (SNR) and thus reduce drastically the inherently exponential decoding complexity. This will also result in reducing the average power consumption of the decoding algorithm; (iii) Ease of implementation and reduced (average and worst-case) complexities: Inherently, complexity at low signal-to-noise levels, e.g. near capacity, tends to be exponential for optimal SDD. It is desired to have procedures which automatically adapt to the channel conditions. That is, allowing very low number of computations at high signal-to-noise levels, and relatively more complexity at lower signal-to-noise levels; (iv) Generic decoding procedures: it is desirable to implement ECC procedures in which the code used can be easily replaced with other code (by changing one of the code parameter as the length, dimension, minimum Hamming distance etc.) to better suit the needs. The decoding procedures should ideally be general enough to decode substantially any linear block code from the same family. Furthermore, the decoding procedure should not require an algebraic Hard Decoder (HD) as part of the soft decision decoding procedure, like most known SDD approaches.

The brute force approach to solve the problem includes of computations of all Euclidean distances between received vector and all codewords, and is known to be an NP-hard problem. While efficient approaches as Low-density parity-check code (LDPC) and Turbo-codes for long codes that approach the SP59 are recently available, the problem for short blocks of less length shorter than 1000 bits is open. An important example for such case is sending short packages over wireless communications systems, in which channel signal-to-noise conditions are considerably changing.

Most prior art approaches require algebraic HD and many repeated operations of the hard decoder are required when the channel noise is high and signal-to-noise ratio is low. It is desirable to acquire an algorithm that can be applied efficiently to large number of block codes, and which does not require any hard decision decoder as part of the SDD scheme.

SUMMARY OF THE INVENTION

A receiver, including a memory unit and a processor, wherein the memory unit stores a sorted parity check matrix that is sorted according to reliabilities of columns; wherein reliabilities of columns are responsive to values of information elements of a soft demodulated received information block, wherein the processor is adapted to: (a) iterate over columns of the sorted parity check matrix to find independent columns and dependent columns; (b) find non-redundant dependent columns out of the dependent columns; wherein the finding is responsive to a relationship between a reliability of a dependent column and a reliabilities of multiple independent columns on which the dependent column depends; (c) select, out of a group of combinations of columns, a selected combination; wherein each combination of the group equals a syndrome; wherein the group of combinations includes independent columns and the non-redundant dependent columns; and (d) correct errors in response to the selected combination.

A method for soft decision decoding of information blocks, the method including: (a) iterating over columns a sorted parity check matrix to find independent columns and dependent columns; wherein the sorted parity check matrix is sorted according to reliabilities of columns; wherein reliabilities of columns are responsive to values of information elements of a soft demodulated received information block; (b) finding non-redundant dependent columns out of the dependent columns; wherein the finding is responsive to a relationship between a reliability of a dependent column and a reliabilities of multiple independent columns on which the dependent column depends; (c) selecting, out of a group of combinations of columns, a selected combination; wherein each combination of the group equals a syndrome; wherein the group of combinations includes independent columns and the non-redundant dependent columns; and (d) correcting errors in response to the selected combination.

A computer program product that comprises a computer readable medium that stores instructions for: (a) iterating over columns a sorted parity check matrix to find independent columns and dependent columns; wherein the sorted parity check matrix is sorted according to reliabilities of columns; wherein reliabilities of columns are responsive to values of information elements of a soft demodulated received information block; (b) finding non-redundant dependent columns out of the dependent columns; wherein the finding is responsive to a relationship between a reliability of a dependent column and a reliabilities of multiple independent columns on which the dependent column depends; (c) selecting, out of a group of combinations of columns, a selected combination; wherein each combination of the group equals a syndrome; wherein the group of combinations includes independent columns and the non-redundant dependent columns; and (d) correcting errors in response to the selected combination.

BRIEF DESCRIPTION OF THE DRAWINGS

The foregoing and other objects, features, and advantages of the present invention will become more apparent from the following detailed description when taken in conjunction with the accompanying drawings.

In the drawings, similar reference characters denote similar elements throughout the different views, in which:

FIG. 5 illustrates a matrix that include independent columns and a matrix that includes dependent columns according to an embodiment of the invention.

DETAILED DESCRIPTION OF THE DRAWINGS

Figure 1A:
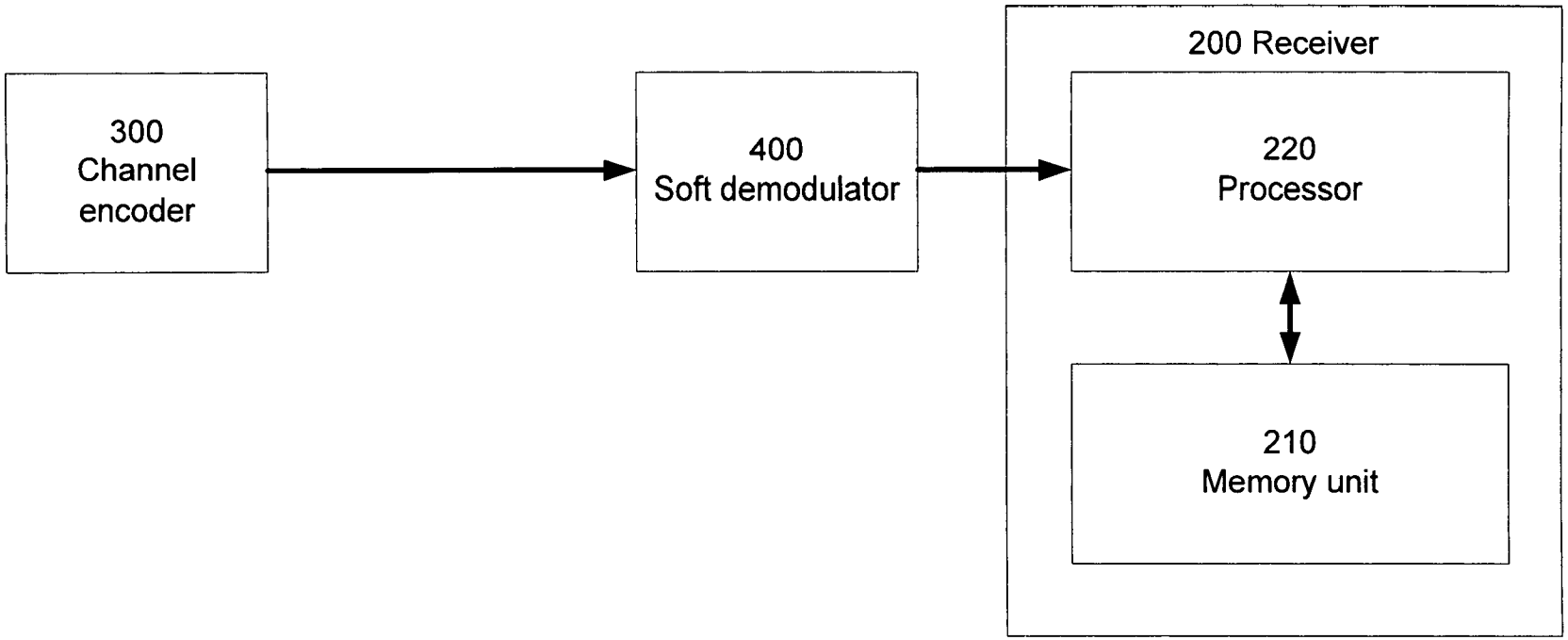
FIG. 1 illustrates a receiver, a channel encoder, and a soft demodulator, according to an embodiment of the invention.
Figure 1B:
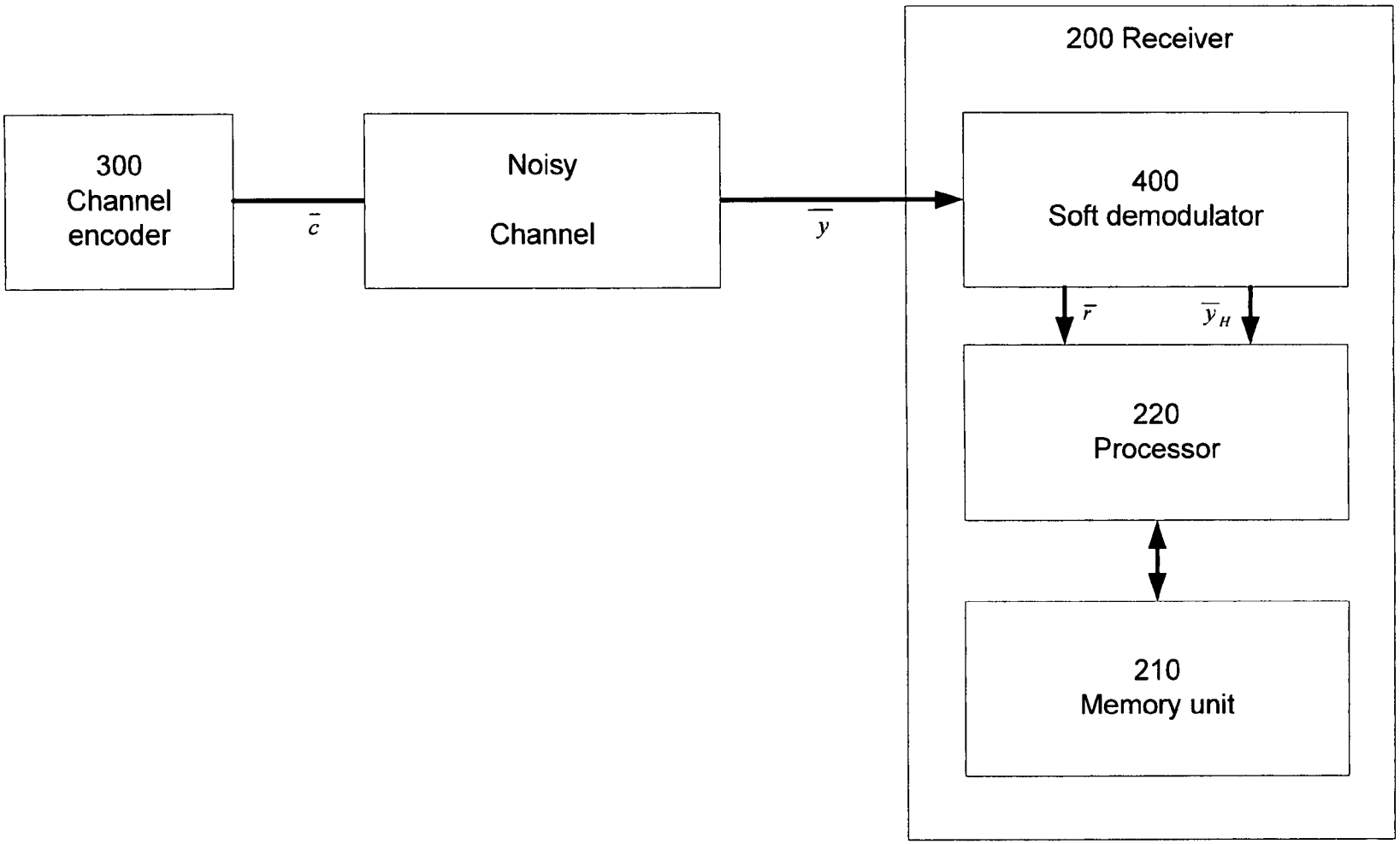

FIG. 1 illustrates receiver 200, channel encoder 300, and soft demodulator 400, according to an embodiment of the invention. Channel encoder 300 encodes received information using an ECC to provide a linear encoded bloke code transmitted as a signal to receiver 200 over a noisy channel that introduces errors into the transmitted signal.

Before being provided into processor 220 of receiver 200, the received signal is being processed by soft demodulator 400, in a way known in the art. It is noted that while soft demodulator 400 is illustrated as external to receiver 200, according to an embodiment of the invention, it can be incorporated within receiver 200.

Soft demodulator 400 is adapted to provide to processor 220 with a soft demodulated received information block, denoted as vector $\bar{y}=(y_1, y_2, \ldots, y_n)$, as well with a hard decision decoded word, $y_h$. It is noted that while the hard decision decoded word $y_h$ includes a series of digits (usually bits) that are determinately determined from the received signal regardless of the likelihood of error in each of the digits (from now on referred to as bits, even though it is noted that in some codes other bases may be implemented), the soft demodulated received information block $\bar{y}$ is a vector of real numbers, responsive to the actual received signal.

Receiver 200 is adapted to process the soft demodulated received information block $\bar{y}$ in order to correct errors in the hard decision decoded word $y_h$, as disclosed below.

Figure 2:
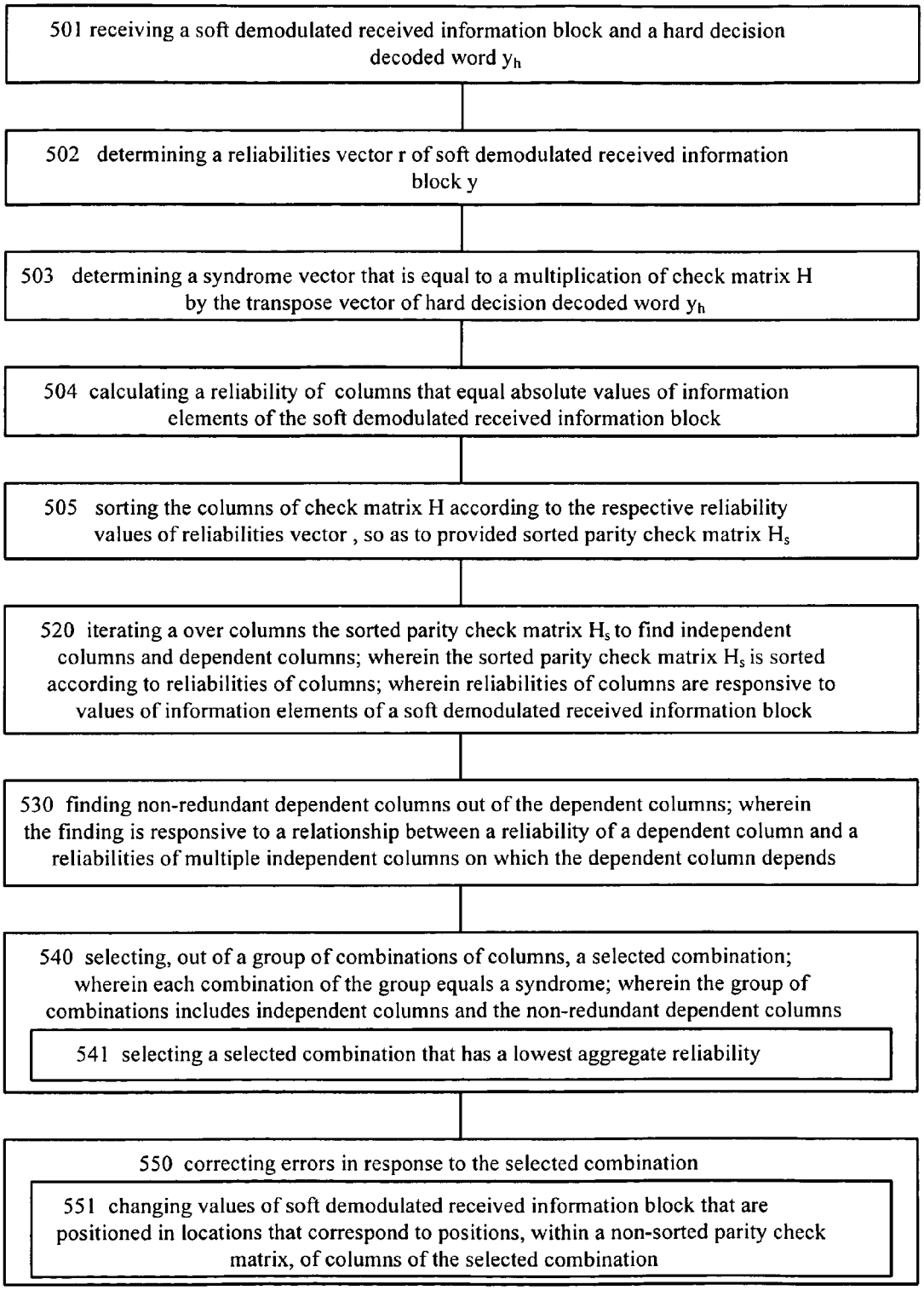
FIG. 2 illustrates a method for soft decision decoding of information blocks, according to an embodiment of the invention.

FIG. 2 illustrates method 500 for soft decision decoding of information blocks, according to an embodiment of the invention. Referring to the examples set forward in the previous drawings, method 500 is conveniently carried out by receiver 200.

Method 500 conveniently starts with stage 501 of receiving a soft demodulated received information block $\bar{y}$ and a hard decision decoded word $y_h$. Alternatively, at least one of the soft demodulated received information block $\bar{y}$ and the hard decision decoded word $y_h$ may be generated as part of method 500. Conveniently, the information received in stage 501 is received from a soft demodulator that is connected to (or included in) the receiver that carried out method 500.

Stage 501 is conveniently followed by stage 502 of determining a reliabilities vector $\bar{r}$ of soft demodulated received information block $\bar{y}$. Conveniently, stage 502 includes determining the reliabilities vector $\bar{r}=(r_1, r_2, \ldots r_n)$ of soft demodulated received information block $\bar{y}$ so that $r_i=|y_i|$, even though other ways of determining the reliabilities vector $\bar{r}$ could be implemented. It is noted that low reliability values indicate that the respective symbol of hard decision decoded word $y_h$ are more likely to be erroneous than symbols of hard decision decoded word $y_h$ for which higher reliability values of reliabilities vector $\bar{r}$ are associated. It is noted that the reliabilities vector $\bar{r}$ could be received (e.g. from the soft demodulator from which the information of stage 501 is received).

Matrix H is a check matrix of the linear code used for coding the information that required decoding. Method 500 conveniently continues with stage 503 of determining a syndrome vector $\bar{s}$ that is equal to a multiplication of check matrix H by the transpose vector of hard decision decoded word $y_h$ (i.e. $\bar{s}=H\square y_H^T$). It is noted that the check matrix is such that the multiplication $M\square C^T$ equals zero for the code word C that includes no errors. Therefore, if the syndrome $\bar{s}$ equals zero, then there is no need to carry out the following stages of method 500.

Assuming that the original word decoded is k symbols long (e.g. k-bits long), and that the encoded word including the error correction symbols is n symbols long, then each of the vectors $\bar{y}y_h$, and $\bar{r}$ includes n digits or real numbers, and check matrix H is of the size $n^xk$. The columns of check matrix H could be associated with reliability values of reliabilities vector $\bar{r}$, and thus the term 'reliability of a column' of check matrix H (and later of sorted parity check matrix $H_s$) could be defined as the reliability value of its associated value in reliabilities vector $\bar{r}$.

Method 500 therefore conveniently continues with stage 504 of calculating a reliability of columns that equal absolute values of information elements of the soft demodulated received information block.

Method 500 than conveniently continues with stage 505 of sorting the columns of check matrix H according to the respective reliability values of reliabilities vector $\bar{r}$, so as to provided sorted parity check matrix $H_s$ (wherein the reliability value associated with the i-th column of check matrix H is $r_i$). For the convenience of explanation, it is assumed from now on that the columns of check matrix H that are associated with low reliability value are the first columns of sorted parity check matrix $H_s$, while higher reliability values are associate with the last columns of sorted parity check matrix $H_s$, even though clearly the opposite way could be implemented, mutatis mutandis.

Method 500 continues with stage 520 of iterating over columns sorted parity check matrix $H_s$ to find independent columns and dependent columns; wherein the sorted parity check matrix $H_s$ is sorted according to reliabilities of columns; wherein reliabilities of columns are responsive to values of information elements of soft demodulated received information block $\bar{y}$.

The iterating of stage 520 conveniently includes iterating over the columns from the column associated with the lowest reliability value to the column associated with the highest reliability value, according to the order of the columns of sorted parity check matrix $H_s$, and for each of the columns determining if it depends (i.e. linearly depends) on any of the previously examined columns or on a combination thereof, wherein if it such depends, then the examined column is determined a dependent column, and if it does not depend on previously examined columns, then the examined column is determined an independent column.

Giving the order of the iteration, it is clear to a person who is skilled in the art that each of the group of independent columns and the group of the dependent columns is an ordered group, for which the columns with the least reliability values are first in order. The sorted group $H_D$ includes all the sorted columns of the dependent columns, and the sorted group $H_I$ includes all the sorted columns of independent columns.

Putting it in other words, the iterating of stage 520 includes iterating on the columns $h_i$ of sorted parity check matrix $H_s$ according to their reliabilities in ascending order, wherein for each column $h_i$: (a) if $h_i$ is linearly-independent on columns from $H_I$, then it is added to $H_I$ and marked $I_{|HI|}$; (b) otherwise, $h_i$ is added to $H_D$ and marked $D_{|HD|}$. In the end of this process we shall have $H_I=(I_1, I_2, \ldots, I_{n-k})$ of linearly independent columns, and $H_D=(D_1, D_2, \ldots, D_k)$ of columns which depend on columns from $H_I$, both groups are ordered by their reliabilities. FIG. 5 illustrates a sample of a sorted parity check matrix $H_s$ that includes independent columns I1-I8 and dependent columns D1-D7 and the reliabilities assigned to each columns. In the example of FIG. 5 the reliabilities range between 0.08 to 2.02.

It should be noted that not necessarily for every i and j $|I_i|<|D_j|$. It should also be noted that since $H_I$ contains n-k linearly-independent columns of length n-k, any combination of columns of $H_I$ could be decomposed into a singular combination of columns from $H_I$.

Stage 520 is followed by stage 530 of finding non-redundant dependent columns out of the dependent columns; wherein the finding is responsive to a relationship between a reliability of a dependent column and a reliabilities of multiple independent columns on which the dependent column depends.

That is, redundant dependent columns are now eliminated from $H_D$. Conveniently, this eliminating is carried out by iterating over $H_D$ and eliminating dependent columns whose reliability value is higher than the sum of reliability values of the independent columns of $H_I$ on which it depends. For example: suppose $D_4=I_1+I_3$, if $|D_4|>|I_1|-|I_3|$ then $D_4$ is redundant.

Stage 530 is followed by stage 540 of selecting, out of a group of combinations of columns, a selected combination; wherein each combination of the group of combinations equals the syndrome $\bar{s}$; wherein the group of combinations includes independent columns and non-redundant dependent columns. Each combination of the group can include one or more independent columns, one or more non-redundant dependent columns or a combination thereof.

Conveniently, stage 540 includes stage 541 of selecting a selected combination that has a lowest aggregate reliability. That is, for each combination of the group of combinations, the aggregate reliability equals the sum of the reliability values associated with each of the columns of the combination, whether dependent or independent columns. It should be noted that the selecting of stage 540 is conveniently aimed at finding the digits (respective to the columns) of the hard decision decoded word $y_h$ that are more likely to be erroneous. Therefore, as the combinations of the group of combinations includes combinations of columns which are linearly addable to provide the syndrome $\bar{s}$, selecting the combination which is least likely to be correct would give the desired combinations of digits to be corrected.

Method 500 continues with stage 550 of correcting errors in response to the selected combination. Conveniently, stage 550 includes stage 551 of changing values of a hard decision decoded word $y_h$ that are positioned in locations that correspond to positions, within a non-sorted parity check matrix (i.e. check matrix H), of columns of the selected combination.

Figure 3:
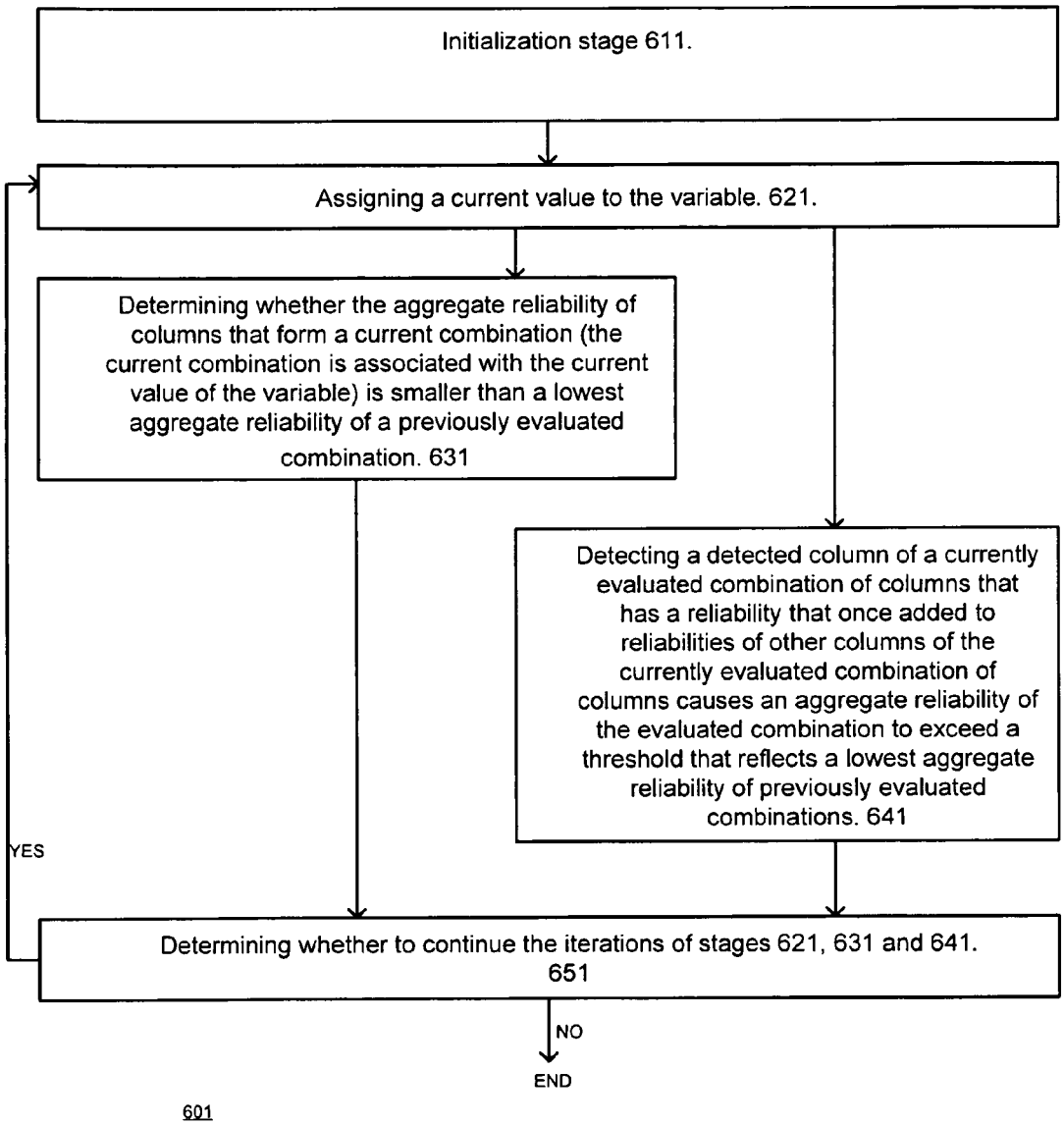
FIG. 3 illustrates a method, according to an embodiment of the invention.
Figure 4:
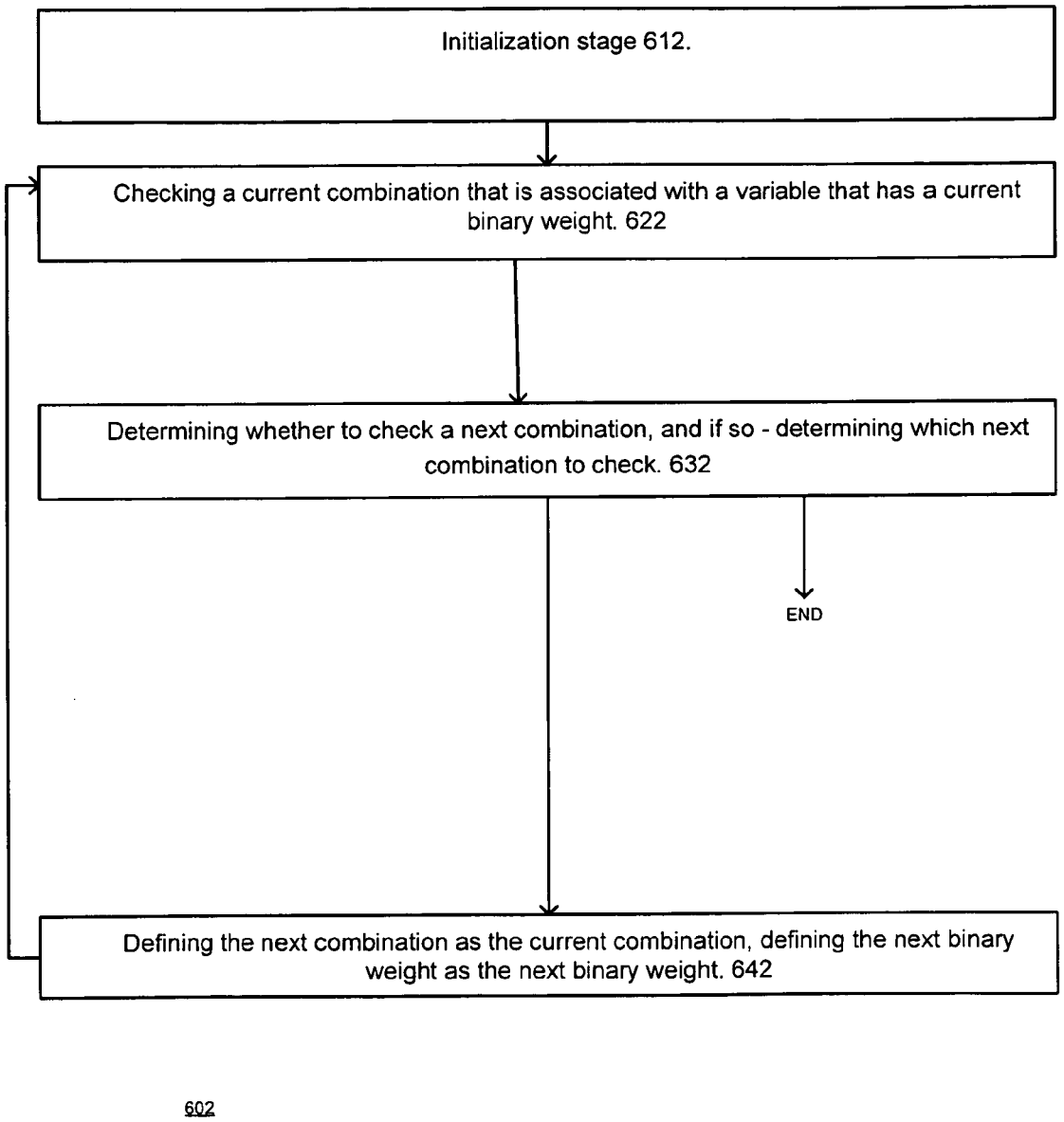
FIG. 4 illustrates a method, according to an embodiment of the invention.

Stage 540 can include method 601 of FIG. 3 or method 602 of FIG. 4.

FIG. 3 illustrates method 601 for selecting of a selected combination according to an embodiment of the invention.

Method 601 includes selecting, out of a group of combinations of columns, a selected combination. Each combination of the group equals a syndrome. A group of combinations includes independent columns and non-redundant dependent columns. Accordingly, each combination includes multiple columns—zero or more dependent columns and zero or more non-redundant dependent columns.

Conveniently, method 601 includes selecting a selected combination that has a lowest aggregate reliability. The aggregate reliability of a combination is the sum of reliabilities of each column of the combination. The lowest aggregate reliability indicates that errors most likely occurred in soft demodulated received information elements of a soft demodulated received information block associated with the columns that form the selected combination.

Method 601 is executed in an iterative manner—it can include multiple iterations of a sequence of stages that includes stages 621, 631 and 641.

Method 601 starts by initialization stage 611. Stage 611 can include setting an initial aggregate reliability value to a predetermined value that is expected to be higher than an aggregate reliability of each column of the group. Stage 610 can include setting a variable that indicates which columns are included in a combination to an initial value. The value can be zero but this is not necessarily so.

Conveniently, the variable is a binary variable. A zero value variable ('000000000') can indicate that a combination includes independent columns only. If the value of the variable differs from zero than each set bit ('1') represents a non-redundant dependent column that belongs to a certain combination. It is noted that the columns can be represented in other manners, for example, by non-binary variable. It is also noted that multiple variables can be defined instead of a single variable.

Stage 611 is followed by stage 621 of assigning a current value to the variable. At the first iteration of the sequence the current value equals the initial variable value assigned during stage 611.

Stage 621 is followed by stage 631 of determining whether the aggregate reliability of columns that form a current combination (the current combination is associated with the current value of the variable) is smaller than a lowest aggregate reliability of a previously evaluated combination. During the first iteration of stage 601 the lowest aggregate reliability of a previously evaluated combination equals the initial aggregate reliability value.

According to another embodiment of the invention stage 621 is also followed by stage 641 of detecting a detected column of a currently evaluated combination of columns that has a reliability that once added to reliabilities of other columns of the currently evaluated combination of columns causes an aggregate reliability of the evaluated combination to exceed a threshold that reflects a lowest aggregate reliability of previously evaluated combinations.

Stages 631 and 641 are followed by stage 651 of determining whether to continue the iterations of stages 621, 631 and 641. If the answer is positive then stage 651 is followed by stage 621.

Conveniently, stage 621 includes determining whether to assign a current value that has the same binary weight as the previous value of the variable. If such a variable cannot be assigned then stage 621 includes assigning a current value that has another (larger) binary weight—such as the minimal binary weight that is bigger than the binary weight of the previous value of the variable. Accordingly, stage 621 includes: (i) checking a first combination that is associated with a variable that has a binary weight; and (ii) determining whether to check another combination that is associated with a variable of the same binary weight.

The determining of whether to check another combination is responsive to an aggregate reliability of the other combination. For example, stage 621 can include assigning a new value of the same binary weight if an aggregate reliability of the new combination (associated with the new value) is smaller than a lowest aggregate reliability of a combination that was evaluated before the other combination.

Method 601 can be implemented by the following pseudo-code:

```
Let s be the syndrome.
Let y_H be the hard-detected codeword.
Set LowestReliability=∞
While (counter is not finished)
Let b_1, b_2, . . . , b_l be the non-zero bits of the counter's
   current state.
Set CurrentReliability=0
Set SyndromeRemainder=s
for (i=1 to l)
   Set CurrentReliabilit=CurrentReliability
   Set SyndromeRemainder=SyndromeRemainder−D'_i
   If (CurrentReliability>LowestReliability)
      SkipCounter(i)
Decompose SyndromeRemainder into columns of H_I: I_m1,
   I_m2, . . . , I_mp.
For (i=1 to p)
   Set CurrentReliability=CurrentReliability+|I_mi|
If (CurrentReliability<LowestReliability)
   Set BestMatch=y_H
   Flip the bits of BestMatch in the positions that corre-
      spond to D'_1 . . . D'_l and I_m1 . . . I_mp
StepCounter( )
return BestMatch
```

FIG. 4 illustrates method 602 for selecting of a selected combination according to an embodiment of the invention.

Method 602 starts by initialization stage 612. Stage 612 is analogues to stage 611.

Stage 612 is followed by stage 622 of checking a current combination that is associated with a variable that has a current binary weight.

Stage 622 is followed by stage 632 of determining whether to check a next combination, and if so—determining which next combination to check.

Stage 632 can include determining whether to check a next combination that is associated with a variable that has the first binary value or another binary weight.

Stage 632 can be followed (if determined to check the next combination) by stage 642 of defining the next combination as the current combination, defining the next binary weight as the next binary weight and jumping to stage 622 in which the next combination is checked.

Stage 632 can involve at least one of the following: (i) determining to check a next combination that is associated with the current binary weight if an aggregate reliability of the next combination is smaller than a lowest aggregate reliability of a previously evaluated combination; (ii) determining not to check the next combination (hence stopping the checking) if a variable of the current combination equals a sequence of '1' that is followed by a sequence of '0'; (iii) detecting a detected column of a currently evaluated combination of columns that has a reliability that once added to reliabilities of other columns of the currently evaluated combination of columns causes an aggregate reliability of the evaluated combination of columns to exceed a threshold that reflects a lowest reliability of previously evaluated combinations of columns; (iv) determining not to check the next combination (hence stopping the checking) if a variable of a certain combination comprises a m-bit long sequence of '1' that is followed by a l-bit long sequence of '0'; wherein a sum of m and l equals s or is greater than s; wherein s is indicative of the detected column.

Conveniently, two consecutive iterations of stages 622, 632 and 642 can include checking (evaluating) a first combination and then checking (evaluating) a second combination. A variable that represents the first combination includes an m-bit long sequence of '1' that is followed by a q1-bit long sequence of '0', followed by a single '1', followed by a q2 sequence of '0', followed by a q3-bit long sequence of '1' and followed by a '0'. A variable that represents the second combination comprises an (m+q3)-bit long sequence of '1' that is followed by a (q1+q2+1)-bit long sequence of '0', followed by a single '1'. A sum of m and q1 is smaller than s; q1 and q3 do not exceed q2. Variables q1 and q3 are equal to one or greater than one. Variable s is indicative of the detected column.

Conveniently, two consecutive iterations of stages 622, 632 and 642 can include checking (evaluating) a first combination, determining (during stage 632) whether two conditions are fulfilled and then evaluating a second combination if the two conditions are fulfilled or stopping the checking if at least one of the two conditions is not fulfilled. A variable that represents the first combination equals an m-bit long sequence of '1' that is followed by a q1-bit long sequence of '0', followed by a single '1', followed by a q2 sequence of '0', followed by a q3-bit long sequence of '1'; wherein q1 is a positive integer and a sum of m and q1 is smaller than s; wherein s is indicative of the detected column. A variable that represents the second combination equals an (m+q3+2)-bit long sequence of '1' that is followed by a (q1+q2−1)-bit long sequence of '0'. The first condition is fulfilled if a sum of m, q3 and one is smaller than a sum of m. The second condition is fulfilled if a sum of q1, q2 and one is smaller than q3. Variable s is indicative of the detected column.

Method 602 can be illustrated by the following example, using a pattern-matching approach. This description proves that the skip operation (between one value of the variable to another) does not skip any potentially 'useful' code words:

SkipCounter(s):

Case 1:

$$\begin{pmatrix} 1^m 0^l \\ 1^m 0^l \ldots \quad | \ (m+l \geq s) \end{pmatrix} \rightarrow \text{Stop}$$

Case 2:

$1^m 0^{l_1} 1 0^{l_2} 1^{l_3} 0 \ldots \rightarrow 1^{m+l_3} 0^{l_1+l_2+1} 1 \ldots$ $(m+l_1<s, l_2 \geqq 0, l_1, l_3 \geqq 1)$ Case 3:

$1^m 0^{l_1} 1 0^{l_2} 1^{l_3} | (l_1)>0, m+l_1<s)$ if $(m+l_3+1<s)\hat{}(l_3<l^1+l^2+1)$ then$\rightarrow 1^{m+l_3+2} 0^{l_1+l_2-1}$ else$\rightarrow$Stop The following table illustrates 4 unrelated examples of the results of a step counter operation and of a skip counter operation.

| Current Counter State | Function | Next Counter State |
|---|---|---|
| 01100 | StepCounter | 10010 |
| 000$\underline{1}$0 | SkipCounter(4) (s = 4) | 11000 |
| 0101$\underline{0}$$\underline{1}$0 | SkipCounter(6) (s = 6) | 100011 |
| 11$\underline{1}$010 | SkipCounter(3) (s = 3) | (finished) |

The following example will further explain method 500.

Assuming that the code is a BCH[15,7,5] code. It has a well known H.

Supposing that vector y is (−1.82, −1.26, −0.08, −1.24, −0.7, −1.42, −0.54, −0.4, −0.36, −1.66, 0.24, −2.02, −0.32, 1.04, −0.48).

The reliability vector r is 1.82, 1.26, 0.08, 1.24, 0.7, 1.42, 0.54, 0.4, 0.36, 1.66, 0.24, 2.02, 0.32, 1.04, and 0.48).

The hard-detected received vector yh is 1,1,1,1,1,1,1,0,1, 1,0,1 (positive elements of y are mapped to zero while negative elements of y are mapped to one).

The syndrome is (0,0,0,1,0,0,1,0).

Sorted independent columns (with their corresponding reliabilities) are:

| I1 | I2 | I3 | I4 | I5 | I6 | I7 | I8 |
|---|---|---|---|---|---|---|---|
| 0.08 | 0.24 | 0.32 | 0.36 | 0.4 | 0.48 | 0.54 | 0.7 |
| 0 | 0 | 0 | 0 | 1 | 0 | 0 | 0 |
| 1 | 0 | 0 | 1 | 0 | 0 | 0 | 1 |
| 1 | 0 | 0 | 0 | 0 | 0 | 0 | 0 |
| 0 | 1 | 0 | 0 | 0 | 0 | 1 | 1 |
| 0 | 0 | 0 | 0 | 0 | 0 | 0 | 1 |
| 1 | 0 | 1 | 0 | 0 | 0 | 1 | 1 |
| 1 | 0 | 0 | 0 | 0 | 0 | 1 | 0 |
| 1 | 0 | 0 | 0 | 0 | 1 | 1 | 0 |

The sorted dependent columns (with their corresponding reliabilities) are:

| D1 | D2 | D3 | D4 | D5 | D6 | D7 |
|---|---|---|---|---|---|---|
| 1.04 | 1.24 | 1.26 | 1.42 | 1.66 | 1.82 | 2.02 |
| 0 | 1 | 1 | 0 | 0 | 1 | 0 |
| 0 | 0 | 1 | 0 | 0 | 0 | 0 |
| 0 | 1 | 0 | 1 | 1 | 0 | 0 |
| 0 | 1 | 0 | 0 | 0 | 0 | 0 |
| 0 | 1 | 1 | 1 | 0 | 1 | 1 |
| 0 | 0 | 1 | 1 | 0 | 0 | 0 |
| 1 | 0 | 1 | 1 | 0 | 1 | 0 |
| 0 | 0 | 0 | 0 | 0 | 1 | 0 |

Dependent columns D5 and D7 are redundant. For example, for D5:

$$D_5 = I_1 + I_2 + I_4 + I_7;$$

$$|D_5| = 1.66$$

$$|I_1| + |I_2| + |I_4| + |I_7| = 1.22$$

Accordingly, the variable that represents the selected columns includes five bits.

The following table illustrates some evaluated columns:

| Counter state | $\Sigma\|D_{m_i}\|$ | Combinations | Aggregate Reliability | Lowest aggregate Reliability |
|---|---|---|---|---|
| 00000 | 0 | $s = I_3 + I_6 + I_7$ | 1.34 | 1.34 |
| 10000 | 1.04 | $s = D_1 + I_2$ | 1.28 | 1.28 |
| 01000 | 1.24 | $s = D_2 + I_1 + I_2 + I_5 + I_6 + I_8$ | 3.14 | |
| 00100 | 1.26 | $s = D_3 + I_5 + I_8$ | 2.36 | |
| 00010 | 1.42 | (skipCounter(4)) | | |
| 11000 | 2.28 | (skipCounter(2)) | | |
| (counter is finished) | | | | |

The selected combination (of the lowest aggregate reliability) is 10000 which is associated with D1 and I2 that are located (in the non-sorted matrix H) at the $11^{th}$ and the $14^{th}$ locations.

Thus—the $11^{th}$ and $14^{th}$ bits of the hard are flipped to provide a corrected codeword of 111111111111111.

According to an aspect of the invention, a computer program product is disclosed, which includes a computer readable medium that stores instructions for: (a) iterating over columns a sorted parity check matrix to find independent columns and dependent columns; wherein the sorted parity check matrix is sorted according to reliabilities of columns; wherein reliabilities of columns are responsive to values of information elements of a soft demodulated received information block; (b) finding non-redundant dependent columns out of the dependent columns; wherein the finding is responsive to a relationship between a reliability of a dependent column and a reliabilities of multiple independent columns on which the dependent column depends; (c) selecting, out of a group of combinations of columns, a selected combination; wherein each combination of the group equals a syndrome; wherein the group of combinations includes independent columns and the non-redundant dependent columns; and (d) correcting errors in response to the selected combination.

It is noted that the computer readable medium conveniently includes instructions for the carrying out of method 500, method 601 or method 602, and that different embodiments of the computer readable medium includes instructions respective to different embodiments of method 500, even if not explicitly detailed.

According to an embodiment of the invention, the computer program product further stores instructions for selecting a selected combination that has a lowest aggregate reliability.

According to an embodiment of the invention, the computer program product further stores instructions for detecting a detected column of a currently evaluated combination of columns that has a reliability that once added to reliabilities of other columns of the currently evaluated combination of columns causes an aggregate reliability of the evaluated combination of columns to exceed a threshold that reflects a lowest reliability of previously evaluated combinations of columns.

According to an embodiment of the invention, each combination is characterized by a variable that indicates which columns form the combination.

According to an embodiment of the invention, in which each combination is characterized by a variable that indicates which columns form the combination, the computer program product further stores instructions for checking multiple combinations out of the group of combinations in response to values of variables associated with each of the multiple combinations.

Referring again to FIG. 1, receiver 200 includes memory unit 210 and a processor 220, wherein memory unit 210 stores a sorted parity check matrix that is sorted according to reliabilities of columns; wherein reliabilities of columns are responsive to values of information elements of a soft demodulated received information block, and wherein processor 220 is adapted to: (a) iterate over columns of the sorted parity check matrix to find independent columns and dependent columns; (b) find non-redundant dependent columns out of the dependent columns; wherein the finding is responsive to a relationship between a reliability of a dependent column and a reliabilities of multiple independent columns on which the dependent column depends; (c) select, out of a group of combinations of columns, a selected combination; wherein each combination of the group equals a syndrome; wherein the group of combinations includes independent columns and the non-redundant dependent columns; and (d) correct errors in response to the selected combination.

It is noted that receiver 200, and especially processor 220, is conveniently adapted to carry out method 500, method 601 or method 602, and that different embodiments of the receiver 200 are adapted to carry out different embodiments of method 500, even if not explicitly detailed.

The present invention can be practiced by employing conventional tools, methodology and components. Accordingly, the details of such tools, component and methodology are not set forth herein in detail. In the previous descriptions, numerous specific details are set forth, in order to provide a thorough understanding of the present invention. However, it should be recognized that the present invention might be practiced without resorting to the details specifically set forth.

Method 601 can be illustrated by the following example. It is assumed that a counting unit can assist in the selecting of a selected combination by applying the following operations: (i) StepCounter operation—advancing to the next binary value whose binary weight equals to the current weight; wherein if such value does not exist, advance to the minimal value with the next binary weight; (ii) SkipCounter(s): Advance to the next value (using StepCounter operation) that can potentially produce lower reliability than the current value.

Conveniently the counting unit starts with all of its bits set to zero, and is 'finished' when neither operation is possible. The counter's less-significant digit is the left one.

It is noted that both functions always keep the current binary weight or advance to the next one. Within the same binary weight, the next binary is value is always greater than the current.

Only exemplary embodiments of the present invention and but a few examples of its versatility are shown and described in the present disclosure. It is to be understood that the present invention is capable of use in various other combinations and environments and is capable of changes or modifications within the scope of the inventive concept as expressed herein.

We claim:

1. A method for soft decision decoding of information blocks, the method comprising:

iterating a over columns a sorted parity check matrix to find independent columns and dependent columns; wherein the sorted parity check matrix is sorted according to reliabilities of columns; wherein reliabilities of columns are responsive to values of information elements of a soft demodulated received information block;

finding non-redundant dependent columns out of the dependent columns; wherein the finding is responsive to a relationship between a reliability of a dependent column and a reliabilities of multiple independent columns on which the dependent column depends;

selecting, out of a group of combinations of columns, a selected combination; wherein each combination of the group equals a syndrome; wherein the group of combinations comprises independent columns and the non-redundant dependent columns; and correcting errors in response to the selected combination.

2. The method according to claim 1 wherein the selecting comprises selecting a selected combination that has a lowest aggregate reliability.

3. The method according to claim 1 wherein the selecting comprises detecting a detected column of a currently evaluated combination of columns that has a reliability that once added to reliabilities of other columns of the currently evaluated combination of columns causes an aggregate reliability of the evaluated combination of columns to exceed a threshold that reflects a lowest reliability of previously evaluated combinations of columns.

4. The method according to claim 1 wherein each combination is characterized by a variable that indicates which columns form the combination.

5. The method according to claim 4 comprising checking multiple combinations out of the group of combinations in response to values of variables associated with each of the multiple combinations.

6. The method according to claim 5 comprising:

checking a first combination that is associated with a variable that has a binary weight; and determining whether to check another combination that is associated with a variable of the same binary weight;

wherein the determining whether to check another combination is responsive to an aggregate reliability of the other combination.

7. The method according to claim 6 comprising checking a further combination that has a minimal binary value that is greater than the binary value of the first combination if determining not to check another combination that is associated with a variable of the same binary weight.

8. The method according to claim 5 comprising:

checking a first combination that is associated with a variable that has a binary weight; and checking another combination that is associated with a variable of the same binary weight if an aggregate reliability of the other combination is smaller than a lowest aggregate reliability of a combination that was evaluated before the other combination.

9. The method according to claim 5 comprising stopping the checking if a variable of a certain combination equals a sequence of '1' that is followed by a sequence of '0'.

10. The method according to claim 4 wherein the selecting comprises detecting a detected column of a currently evaluated combination of columns that has a reliability that once added to reliabilities of other columns of the currently evaluated combination of columns causes an aggregate reliability of the evaluated combination of columns to exceed a threshold that reflects a lowest reliability of previously evaluated combinations of columns.

11. The method according to claim 10 comprising stopping the checking if a variable of a certain combination comprises a m-bit long sequence of '1' that is followed by a l-bit long sequence of '0'; wherein a sum of m and l equals s or is greater than s; wherein s is indicative of the detected column.

12. The method according to claim 10 comprising evaluating a first combination and then evaluating a second combination;

wherein a variable that represents the first combination comprises an m-bit long sequence of '1' that is followed by a q1-bit long sequence of '0', followed by a single '1', followed by a q2 sequence of '0', followed by a q3-bit long sequence of '1' and followed by a '0';

wherein a variable that represents the second combination comprises an (m+q3)-bit long sequence of '1' that is followed by a (q1+q2+1)-bit long sequence of '0', followed by a single '1';

wherein a sum of m and q1 is smaller than s; q1 and q3 do not exceed q2;

wherein q1 and q3 are equal to one or greater than one; and wherein s is indicative of the detected column.

13. The method according to claim 10 wherein the selecting comprises:

evaluating a first combination;

determining whether two conditions are fulfilled;

evaluating a second combination if the two conditions are fulfilled; and stopping the checking if at least one of the two conditions is not fulfilled;

wherein a variable that represents the first combination equals an m-bit long sequence of '1' that is followed by a q1-bit long sequence of '0', followed by a single '1', followed by a q2 sequence of '0', followed by a q3-bit long sequence of '1'; wherein q1 is a positive integer and a sum of m and q1 is smaller than s; wherein s is indicative of the detected column;

wherein a variable that represents the second combination equals an (m+q3+2)-bit long sequence of '1' that is followed by a (q1+q2−1)-bit long sequence of '0';

wherein the first condition is fulfilled if a sum of m, q3 and one is smaller than s a sum of m;

wherein the second condition is fulfilled if a sum of q1, q2 and one is smaller than q3;

wherein s is indicative of the detected column.

14. The method according to claim 1 wherein the correcting of errors comprises changing values of soft demodulated received information block that are positioned in locations that correspond to positions, within a non-sorted parity check matrix, of columns of the selected combination.

15. The method according to claim 1 comprising calculating a reliability of columns that equal absolute values of information elements of the soft demodulated received information block.

16. A non-transitory computer readable medium that stores instructions for carrying out a method that comprises:

iterating a over columns a sorted parity check matrix to find independent columns and dependent columns; wherein the sorted parity check matrix is sorted according to reliabilities of columns; wherein reliabilities of columns are responsive to values of information elements of a soft demodulated received information block;

finding non-redundant dependent columns out of the dependent columns; wherein the finding is responsive to a relationship between a reliability of a dependent column and a reliabilities of multiple independent columns on which the dependent column depends;

selecting, out of a group of combinations of columns, a selected combination; wherein each combination of the group equals a syndrome; wherein the group of combinations comprises independent columns and the non-redundant dependent columns; and correcting errors in response to the selected combination.

17. The non-transitory computer readable medium according to claim 16 that stores instructions for carrying out the method that further comprises selecting a selected combination that has a lowest aggregate reliability.

18. The non-transitory computer readable medium according to claim 16 that stores instructions for detecting a detected column of a currently evaluated combination of columns that has a reliability that once added to reliabilities of other columns of the currently evaluated combination of columns causes an aggregate reliability of the evaluated combination of columns to exceed a threshold that reflects a lowest reliability of previously evaluated combinations of columns.

19. The non-transitory computer readable medium according to claim 16 wherein each combination is characterized by a variable that indicates which columns form the combination.

20. The non-transitory computer readable medium according to claim 19 that stores instructions for carrying out the method that further comprises checking multiple combinations out of the group of combinations in response to values of variables associated with each of the multiple combinations.

21. A receiver, comprising a memory unit and a processor, wherein the memory unit stores a sorted parity check matrix that is sorted according to reliabilities of columns; wherein reliabilities of columns are responsive to values of information elements of a soft demodulated received information block wherein the processor is adapted to:

iterate a over columns of the sorted parity check matrix to find independent columns and dependent columns;

find non-redundant dependent columns out of the dependent columns; wherein the finding is responsive to a relationship between a reliability of a dependent column and a reliabilities of multiple independent columns on which the dependent column depends;

select, out of a group of combinations of columns, a selected combination; wherein each combination of the group equals a syndrome; wherein the group of combinations comprises independent columns and the non-redundant dependent columns; and correct errors in response to the selected combination.

* * * * *